United States Patent [19]

Tayrani

[11] Patent Number: 4,947,142

[45] Date of Patent: Aug. 7, 1990

[54] ATTENUATION CONTROLLING BY MEANS OF A MONOLITHIC DEVICE

[76] Inventor: Reza Tayrani, 104 Pemmacook Rd., Tewksbury, Mass. 01876

[21] Appl. No.: 137,242

[22] Filed: Dec. 23, 1987

[51] Int. Cl.[5] ..... H01P 1/22

[52] U.S. Cl. ..... 333/81 A; 333/262; 357/15; 357/65; 357/22

[58] Field of Search ..... 333/81 R, 81 A, 247, 333/262; 357/1, 15, 22 I, 65, 22 J

[56] References Cited

U.S. PATENT DOCUMENTS

| | | | |
|---|---|---|---|
| 3,870,976 | 3/1975 | Krause | 333/81 A X |
| 4,245,230 | 1/1981 | Kwok et al. | 333/262 X |
| 4,322,695 | 3/1982 | Fleming et al. | 333/81 A X |
| 4,472,872 | 9/1984 | Toyoda et al. | 357/15 X |
| 4,540,446 | 9/1985 | Nonaka et al. | 357/65 X |
| 4,587,541 | 5/1986 | Dalman et al. | 333/247 X |
| 4,593,307 | 6/1986 | Rupprecht et al. | 357/65 X |
| 4,675,620 | 6/1987 | Fullerton | 333/238 X |
| 4,739,289 | 4/1988 | Cripps | 333/238 X |

FOREIGN PATENT DOCUMENTS

| | | | |
|---|---|---|---|
| 2353634 | 5/1975 | Fed. Rep. of Germany | 333/81 A |
| 2528342 | 4/1976 | Fed. Rep. of Germany | 333/247 |

*Primary Examiner*—Eugene R. Laroche
*Assistant Examiner*—Benny T. Lee
*Attorney, Agent, or Firm*—Fish & Richardson

[57] ABSTRACT

A monolithic device for controlling the transmission of RF energy. The device comprises doped regions selectively implanted along two lateral lines in a buffer layer disposed on a semi-insulating substrate. Two ground conductors are disposed on said doped region to form ohmic contacts therewith, and a signal conductor is disposed directly on the buffer layer between the two ground conductors to form a Schottky contact. The buffer layer is responsive to a DC potential applied between the signal and ground conductors for selectively attenuating RF energy transmitted through the device.

4 Claims, 2 Drawing Sheets

ATTENUATION CONTROLLING BY MEANS OF A MONOLITHIC DEVICE

The invention relates to a monolithic device for controlling the transmission of RF energy over a broad band by attenuating the intrinsic resistance of the buffer layer of the semiconductor device to control the transmission of RF energy.

Generally, a typical microwave control device, such as a PIN diode, may be an electronically-variable resistance device used for switching and controlling GaAs monolithic microwave integrated circuits.

A general feature of the present invention is a co-planar microstrip transmission line that is responsive to a DC potential for selectively attenuating RF energy.

The preferred embodiments of the invention include the following features. A buffer layer of N-type GaAs is grown directly on a semi-insulating substrate. Doped regions having a conductivity greater than that of the buffer layer are selectively implanted in the buffer layer along two lateral lines. A ground conductor is disposed along each said lateral line of doped regions to form an ohmic contact. A signal conductor is disposed directly on the buffer layer between said ground plane microstrips to form a Schottky contact. The buffer layer is responsive to a DC potential applied between the signal and ground conductors for selectively attenuating RF energy transmitted through the device. An advantage of this monolithic device is that it has broadband switching capabilities because of its distributed nature, thus making it suitable for microwave applications. Other advantages and features will become apparent from the following specification when read in connection with the accompanying drawings and claims.

The drawings are briefly described as follows.

Figure 1:
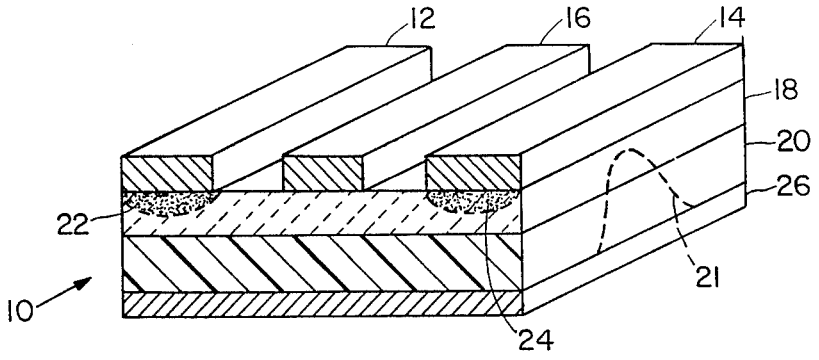
FIG. 1 is a perspective cross-sectional view illustrating a microwave control device embodying the present invention.

With reference to the drawings and more particularly FIG. 1 thereof, there is a perspective cross-sectional view of a GaAs microwave control device 10. The device is essentially a co-planar transmission line comprising two ground conductors 12, 14 and signal conductor 16 deposited on an N-type GaAs buffer layer 18 using current metalization technology. The buffer layer is grown on a GaAs semi-insulating substrate 20 using conventional processes and has pockets 22, 24 of N+ type silicon, which are selectively formed in the buffer layer by ion implantation to establish ohmic contact with ground conductors 12 and 14. These N+ regions 22 and 24 are grounded to a common ground plate 26 through via holes such as 21 with the structure metalized around the holes formed through the semi-insulating region 20. Signal conductor 16, which is deposited directly on the buffer layer 18, forms a Schottky contact. Preferably, separation between signal conductor 16 and ground conductors 12 and 14 and other parameters establish a matched transmission line impedance at each transmission line end (typically 50 ohms).

Figure 2:
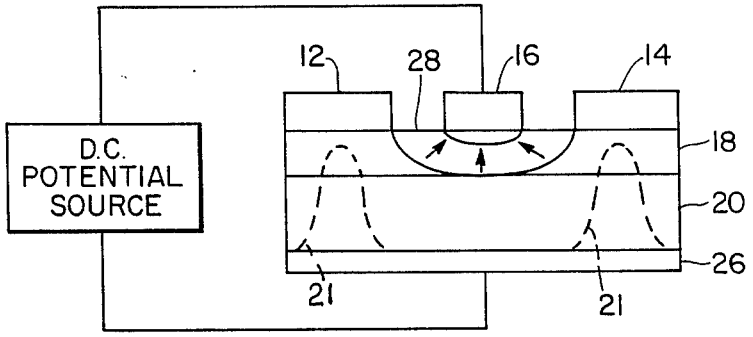
FIG. 2 is a cross-sectional view of the microwave control device illustrating the depletion region in the buffer layer.

Referring to FIG. 2, the operation of the transmission line is as follows. The amount of RF energy transmitted is controlled by modulating the depletion region 28 of buffer layer 18 by means of a D-C potential source. Depletion region 28 characteristically has high resistivity and acts as an insulator between signals conductor 16 and ground conductors 12, 14. A state of full depletion occurs when the signal conductor 16 is zero or negative DC biased with respect to ground plane conductors 12, 14. Increasing the DC potential between signal conductor 16 and ground conductor 12, 14 decreases the size of the depletion region 28 (as indicated by arrows), thereby reducing resistance and increasing conductivity between signal conductor 16 and ground conductors 12, 14. When this conductivity increases, buffer layer 18 operates as a lossy medium and attenuates RF energy transmitted through the circuit. With a large enough forward bias or a long enough circuit, the RF signal can be essentially fully attenuated. By changing the resistive characteristics of buffer layer 18, an impedance mismatch will also occur, further attenuating the signal.

Figure 3:
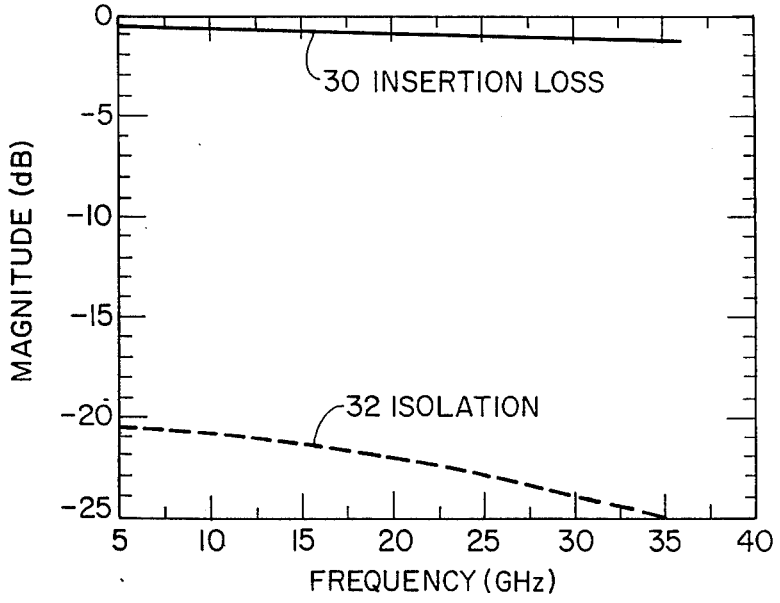
FIG. 3 is a graphical representation of insertion loss and isolation as a function of frequency.

Referring to FIG. 3, there is shown a graphical representation of insertion loss and isolation as a function of frequency. The solid line 30 shows a constant insertion loss, incurred when the switch is in the low-loss state, over a range of 5–40 gigahertz. The insertion loss is not frequency dependent and is typically less than 1 dB. The dashed curve 32 represents isolation, which is the loss incurred as a result of applying a bias to signal conductor 16 relative to ground conductors 12, 14. This curve is a characteristic curve, whose magnitude depends on the amount of bias, but shows that isolation increases with increased frequency.

Figure 4:
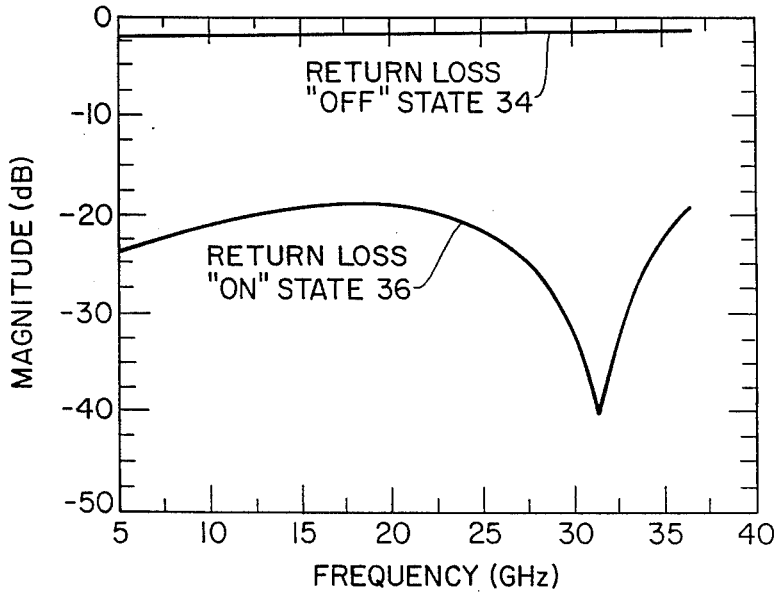
FIG. 4 is a graphical representation of return loss in OFF and ON states as a function of frequency.

Referring to FIG. 4, there is shown a graphical representation of return loss for both the on-state and the off-state of the invention. The return loss is essentially the difference between the power incident upon a discontinuity in a transmission system and the power reflected; from the discontinuity. The curves are based on the general equation $RL=20 \log 1/\rho$ where RL equals the return loss and $\rho$ equals the reflection coefficient. When the device is in the off-state or forward bias state, the dashed line 34 illustrates that there is a small return loss, resulting from a poor impedence match. In the on-state, or when the circuit is propagating the energy, the solid line 36 indicates that the return loss is high, resulting from a good impedence match. The sudden magnitude drop at 31 GHz is caused by a resonance. The device thus acts as a switch which blocks energy flow when the device is in the off-state and propagates energy when the device is in the on-state, or reverse-bias state.

Other embodiments are within the following claims.

What is claimed is:

1. A monolithic device for controlling the transmission of RF energy comprising:

a buffer layer having a predetermined conductivity, said buffer layer disposed on a semi-insulating substrate;

doped regions selectively implanted in the buffer layer along two lateral lines, wherein the doped regions have a conductivity greater than the conductivity of the buffer layer;

respective ground conductors disposed along each said lateral lines of doped regions to form an ohmic contact between each of said ground conductors and a respective one of said doped regions; and a signal conductor disposed directly on the buffer layer between said ground conductors to form a Schottky contact between said signal conductor and said buffer layer;

a common ground plate, said semi-insulating substrate separating said buffer layer from said common ground plate, said semi-insulating substrate having via holes grounding said doped regions to said common ground plate;

wherein said buffer layer is responsive to a source of DC potential connected between said signal and ground conductors for selectively attenuating the RF energy transmitted through said device.

2. A monolithic device according to claim 1 wherein said source of said DC potential selectively alters the conductivity of the buffer layer.

3. A monolithic device according to claim 1 wherein the separation between said signal and ground conductors has a value establishing a matched terminating impedance at each end of said device.

4. A monolithic device according to claim 1 wherein the buffer layer is an N-type GaAs layer grown directly on said semi-insulating layer.

* * * * *